United States Patent [19]

Sukekawa et al.

[11] Patent Number: 5,062,614

[45] Date of Patent: Nov. 5, 1991

[54] APPARATUS AND METHOD FOR MANUFACTURING COPPER-BASE ALLOY

[75] Inventors: Izumi Sukekawa, Matsudo; Haruhiko Asao, Abiko; Hiroshi Kohno, Iwaki; Yukio Sugawara, Iwaki; Keiji Nogami, Iwaki, all of Japan

[73] Assignee: Mitsubishi Kinzoku Kabushiki Kaisha, Japan

[21] Appl. No.: 90,652

[22] Filed: Aug. 28, 1987

[30] Foreign Application Priority Data

Sep. 2, 1986 [JP] Japan ..... 61-206133

[51] Int. Cl.[5] ..... C21C 7/00

[52] U.S. Cl. ..... 266/216; 266/275

[58] Field of Search ..... 266/216, 234, 275, 221; 75/76; 420/469

[56] References Cited

U.S. PATENT DOCUMENTS

| | | | |
|---|---|---|---|
| 336,439 | 2/1886 | Samuel | 266/221 |
| 3,321,300 | 5/1967 | Worner | 266/216 |
| 3,785,427 | 11/1974 | De Bie | 164/154 |
| 3,836,360 | 9/1974 | Bray | 266/216 |
| 4,277,281 | 7/1981 | Weber et al. | 75/76 |
| 4,330,328 | 5/1982 | Tyler et al. | 266/216 |
| 4,630,801 | 12/1986 | Rellis, Jr. et al. | 266/216 |

FOREIGN PATENT DOCUMENTS

| | | | |
|---|---|---|---|
| 7212785 | 11/1973 | France . | |
| 121056 | 6/1985 | Japan . | |
| 0964008 | 10/1982 | U.S.S.R. | 266/234 |
| 1100475 | 11/1968 | United Kingdom . | |
| 1181518 | 2/1970 | United Kingdom . | |

OTHER PUBLICATIONS

Vedkalov et al, "A prototype electromagnetic apparatus for treating flowing liquid metal" 1/74.

Patent Abstracts of Japan, vol. 9, No. 275 (M-426)[1988], Nov. 2, 1985; & JP-A-60 121 056 (Furukawa Denki Kogyo K.K.) 28-06-1985.

*Primary Examiner*—S. Kastler

*Attorney, Agent, or Firm*—Scully, Scott, Murphy & Presser

[57] ABSTRACT

There are provided an apparatus and a method for manufacturing a copper-base alloy. The apparatus includes an alloying spout, at least one feeder and a tundish. The tundish is inclined downwardly from one end toward the other end for flowing a molten copper therethrough. The feeder is connected to the alloying spout for introducing at least one solid solute constituent into the alloying spout. The method includes the steps of providing the above apparatus, continuously introducing the molten copper from the inlet into the passageway of the alloying spout and causing the molten copper to flow downwardly through the passageway to the outlet, and continuously introducing the solid solute constitutent into the passageway of the alloying spout through the feeder to mix the solute constituent with the molten copper to produce the copper-base alloy.

6 Claims, 2 Drawing Sheets

APPARATUS AND METHOD FOR MANUFACTURING COPPER-BASE ALLOY

BACKGROUND OF THE INVENTION

1. Field of the Invention

The present invention relates to an apparatus and a method for manufacturing a copper-base alloy having a quite uniform chemical composition.

2. Prior Art

In manufacturing a copper-base alloy, there has conventionally been employed a batch process, in which solute metals are alloyed with copper in a melting furnace.

The batch process, however, has been disadvantageous in that every time the kinds of copper-base alloys to be manufactured are changed, the inside of the melting furnace has to be washed. As a result, a large quantity of a melt has been required for washing, and it is laborious to carry out such washing. In addition, inasmuch as the intermittent operation deteriorates the rate of operation of the melting furnace, the productivity has been lowered, resulting in a high production cost. Besides, since the solute constituents are difficult to be mixed uniformly with copper, the alloy thus produced has not complied with a desired quality.

SUMMARY OF THE INVENTION

It is therefore an object of the present invention to provide a copper alloy manufacturing apparatus which can melt a solute constituent in a molten copper uniformly to continuously produce a copper alloy having a uniform chemical composition with a reduced cost.

Another object is to provide a method of manufacturing a copper alloy by using such an apparatus.

According to a first aspect of the present invention, there is provided an apparatus for manufacturing a copper-base alloy, comprising an alloying spout inclined downwardly from one end toward the other end for flowing a molten copper therethrough, the alloying spout including an inlet at the one end and an outlet at the other end and having an elongated passageway through which the inlet communicates with the outlet, whereby the molten copper introduced from the inlet can flow downwardly through the passageway to the outlet; feed means connected to the alloying spout for introducing at least one solid solute constituent into the passageway of the alloying spout to thereby mix the solute constituent with the molten copper to produce the molten copper-base alloy; and a tundish disposed at the other end of the alloying spout for receiving the molten copper-base alloy tapped from the alloying spout.

According to a second aspect of the present invention, there is provided a method of manufacturing a copper-base alloy, comprising the steps of providing an apparatus comprising an alloying spout inclined downwardly from one end toward the other end for flowing a molten copper therethrough, the alloying spout including an inlet at the one end and an outlet at the other end and having an elongated passageway through which the inlet communicates with the outlet, and feed means connected to the alloying spout for introducing at least one solid solute constituent into the passageway of the alloying spout; continuously introducing the molten copper from the inlet into the passageway of the alloying spout and causing the molten copper to flow downwardly through the passageway to the outlet; and continuously introducing the at least one solid solute constituent into the passageway of the alloying spout through the feed means to mix the solute constituent with the molten copper to produce the copper-base alloy.

DESCRIPTION OF THE PREFERRED EMBODIMENTS OF THE INVENTION

Figure 1:
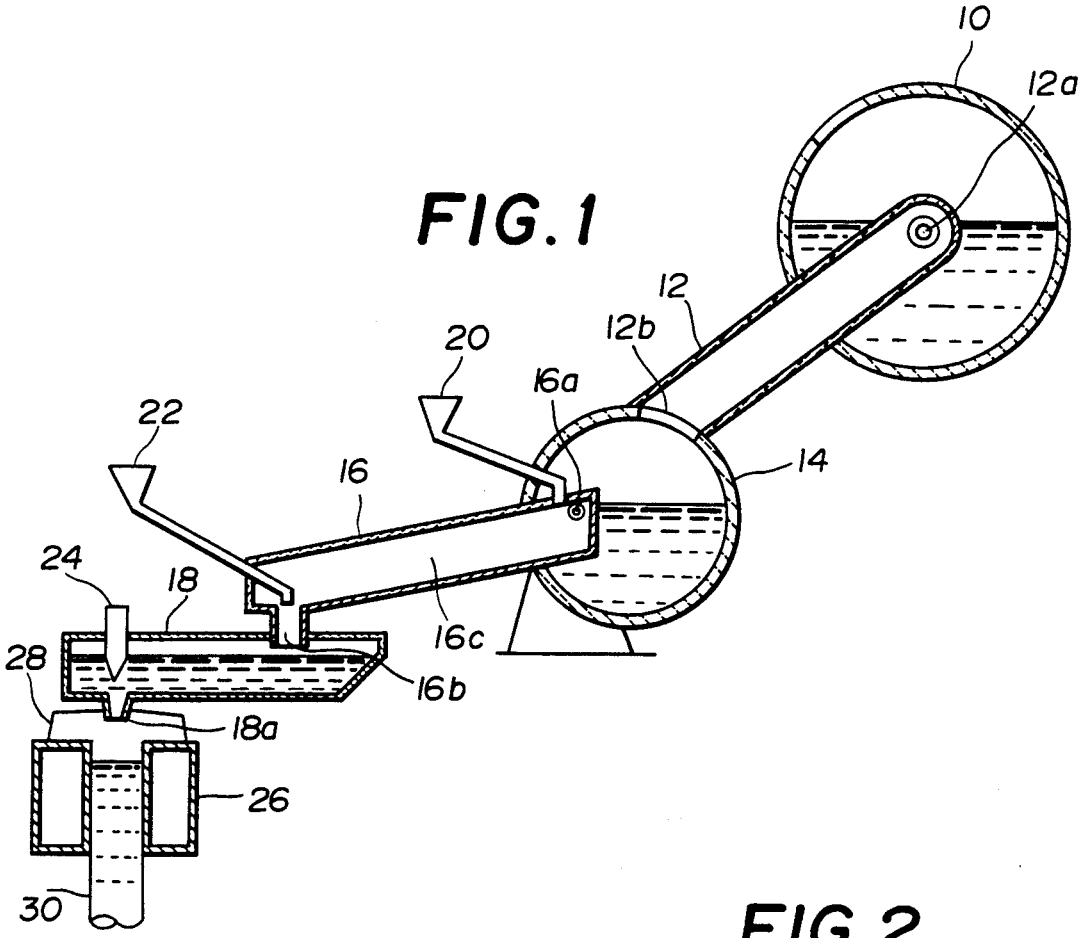
FIG. 1 is a schematic cross-sectional view showing an apparatus in accordance with the present invention.
Figure 2:
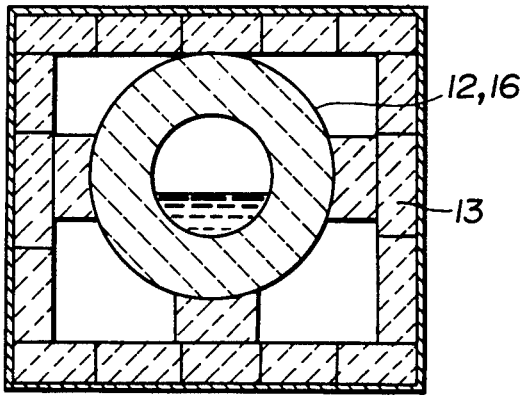
FIG. 2 is a schematic transverse cross-sectional view of an alloying spout mounted in the apparatus of FIG. 1.

Referring to FIGS. 1 and 2, there is illustrated an apparatus for manufacturing a copper-base alloy, which comprises a melting crucible furnace 10 for melting a solid copper material to produce a molten copper. A pouring spout 12, which is inclined downwardly from one end toward the other end and has an inlet 12*a* at the one end and an outlet 12*b* at the other end, is connected at the one end to the melting furnace 10, and a holding furnace 14 is disposed at the other end of the pouring spout 12 for holding the molten copper tapped from the pouring spout 12 in an oxygen-free state and keeping the temperature of the molten copper at a prescribed level. As shown in FIG. 2, the pouring spout 12 is accommodated in a refractory brick-lined housing 13, and a reducing gas, which consists of a mixture of carbon monoxide gas and nitrogen gas, is contained in the spout 12.

An alloying spout 16, which is inclined downwardly from one end toward the other end, is connected at the one end to the holding furnace 14 for causing the molten copper tapped from the holding furnace 14 to flow downwardly therethrough. The alloying spout 16 is comprised of a hermetically sealable casing having an inlet 16*a* at the one end and an outlet 16*b* at the other end and an elongated passageway 16*c* through which the inlet 16*a* communicates with the outlet 16*b*, and an inert gas or a reducing gas is filled in the passageway 16*c*. As is the case with the pouring spout 12, the alloying spout 16 is accommodated in a refractory brick-lined housing 13. A pouring basin or tundish 18, which is also comprised of a hermetically sealable casing, is disposed at the other end of the alloying spout 16 for receiving the molten metal tapped from the alloying spout 16, and graphite powder is contained in the tundish to cover the surface of the molten metal for sealing purposes. First and second feeders 20 and 22 are respectively connected to the alloying spout 16 for introducing solid solute constituents into the passageway 16*c* of the alloying spout 16, the first feeder 20 being connected to an upstream portion of the spout 16 adjacent to the one end thereof while the second feeder 22 is connected to a downstream portion of the spout 16 adjacent to the other end thereof. The passageway 16*c* of the alloying spout 16 should be long enough to melt the solute constituents to mix them with the molten copper during the passage of the molten copper through the passageway 16*c*.

The solute constituents to be alloyed with copper are different depending upon the kinds of the copper alloys to be produced. As such solute constituents, many elements such as chromium (Cr), zirconium (Zr), titanium (Ti), silicon (Si), nickel (Ni), iron (Fe), magnesium (Mg), tin (Sn), tellurium (Te), arsenic (As), phosphorus (P), aluminium (Al), zinc (Zn), beryllium (Be), W (tungsten) and the like may be alloyed with copper. With respect to an element having a higher melting point as compared with copper, such as Cr, Zr, Ti, Si, Ni and Fe, a solid material of a high purity should preferably be used. Such pure solid material may be in the form of granules, grains, wires, pieces, powders or the like.

The outer shell of the tundish 18 has an opening in the bottom, in which is fitted a nozzle 18*a* with a stopper 24. By raising and lowering the stopper 24, the quantity of the molten copper alloy to be tapped from the tundish 18 can be controlled. A mould 26 is disposed under the tundish 18 for continuously casting the molten alloy tapped from the nozzle 18*a* of the tundish 18 to produce a cast copper alloy. A sealing shell 28 is mounted between the tundish 18 and the mould 26 for hermetically sealing the inside of the mould and the tundish, and an inert gas is supplied thereinto.

The operation of the copper alloy manufacturing apparatus will now be described.

First, the melting furnace 10 is charged with the solid copper, and the copper is melted. Specifically, in this melting furnace 10, pieces of charcoal are added to prevent the molten copper from being exposed to the air, so that low oxygen molten copper, which contains an oxygen content of not greater than 50 ppm, is produced in it. When the molten copper in the melting furnace 10 exceeds a prescribed level, it overflows into the pouring spout 12 and passes therethrough to the holding furnace 14. In the pouring spout 12, the low oxygen molten copper is reduced by the reducing gas contained therein to an oxygen free molten copper, an oxygen content of which is not greater than 10 ppm.

Subsequently, the oxygen-free molten copper is tapped into the holding furnace 14 and kept at a prescribed temperature. Then, the molten copper overflows into the alloying spout 16 and passes through the passageway 16*c* thereof to flow into the tundish 18. During the passage of the copper through the alloying spout 16, first solid solute constituents, which have high melting points compared with copper and are difficult to be melted, are added through the first feeder 20 into the passageway 16*c* of the alloying spout 16, and second solute constituents, which have low melting points compared with copper, are added through the second feeder 22 into the passageway 16*c* of the spout 16. In this step, inasmuch as the molten copper is flowing through the passageway 16*c* at a sufficient flow rate, the solute constituents introduced into the passageway 16*c* are mixed with the molten copper uniformly and melted quickly, and thus a molten copper-base alloy of a uniform chemical composition is produced. In addition, although the first solute constituents have high melting points and are difficult to be melted, they are added in the alloying spout 16 at its upstream portion, and therefore they can be sufficiently alloyed with the copper during the passage through the elongated passageway 16*c*. With respect to the second solute constituents having low melting points, they are added in the spout 16 at its downstream portion, but are easily mixed with and alloyed with the copper. Some solute constituents having higher solubilities may be added in the tundish 18. Further, the solute constituents may preferably be preheated to temperatures near to their melting points before they are added.

The molten copper alloy thus produced is tapped from the alloying spout 16 into the tundish 18, and teemed from the tundish 18 into the mould 26 through the nozzle 18*a*, so that a cast product 30 of copper alloy is manufactured.

Although in the foregoing, the solute constituents are alloyed with the oxygen free copper in the alloying spout 16, they may be alloyed with low oxygen copper or deoxidized copper. However, if the solute constituent to be added is an active or reactive element such as Cr, Ti, Zr, Si, Mg, Ca, Al and the like, which has a great affinity for oxygen, such element combines with oxygen to thereby lower the yield of the alloy. In such a case, the low oxygen copper may be preferably used.

Figure 3:
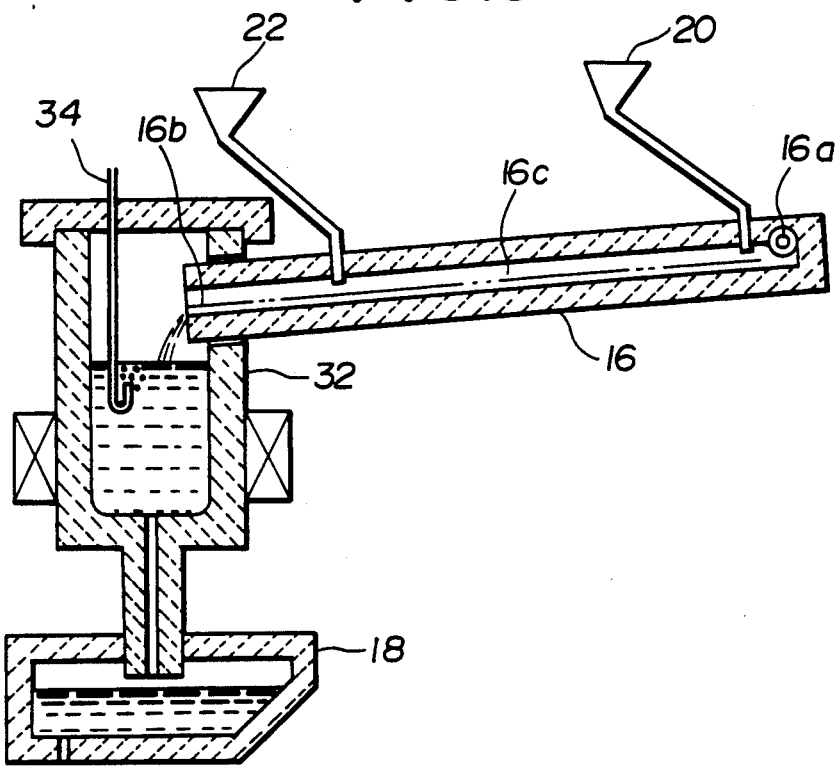
FIG. 3 is a schematic cross-sectional view showing a part of a modified apparatus in accordance with the present invention.

FIG. 3 shows a modified apparatus in accordance with the present invention which differs from the apparatus of FIGS. 1 and 2 only in that there is provided a heating furnace 32 between the alloying spout 16 and the tundish 18 for heating the molten alloy tapped from the spout 16. The heating furnace 32 is a high frequency induction furnace, to which is attached a bubbling apparatus 34 for blowing an inert gas such as argon into the molten alloy to stir it up. An alloy produced by the apparatus of this embodiment contains a high content of solute elements.

Figure 4:
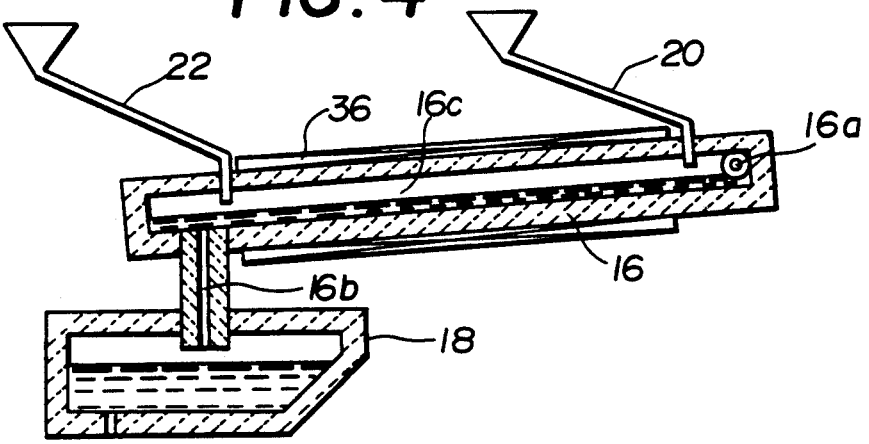
FIG. 4 is a schematic cross-sectional view showing a part of another modified apparatus in accordance with the present invention.

FIG. 4 shows another modified apparatus in accordance with the present invention which differs from the apparatus of FIGS. 1 and 2 only in that heating means 36 is attached to the alloying spout 16 for heating the molten copper and the solute elements passing through the passageway 16*c*.

Further, although in the above embodiments, two feeders are connected to the alloying spout 16, only one feeder may be enough if only a few solute constituents are to be added, or the solubilities of the solute constituents are almost equivalent to each other. In addition, each of the spouts 12 and 16 may be a spout of a U-shaped cross section housed in a hermetically sealable refractory brick-lined housing.

As described above, in the apparatus in accordance with the present invention, the solute constituents are continuously added in the molten copper which is flowing at a sufficient flow rate. Accordingly, the solute constituents added are stirred by the flow of the molten copper and mixed therewith uniformly and melted quickly, and thus the copper-base alloy of a uniform chemical composition is produced continuously. In addition, by changing the quantity of the solute constituents to be added in the alloying spout, the quantity of the alloy to be produced is changed, and besides different kinds of alloys can easily be manufactured. Further, since the alloying is carried out in the alloying spout, there is no need to wash the inside of the melting furnace when changing the kinds of alloys to be manufactured, thus increasing the operating rate of the apparatus substantially.

The invention will now be illustrated by way of the following EXAMPLES.

EXAMPLE 1

Cr-Cu alloys of a desired Cr content ranging from 0.25 to 0.40% by weight were manufactured using the apparatus of FIGS. 1 and 2. For comparison purposes, Cr-Cu alloys of the same desired Cr content were produced by the conventional batch process. The data on Cr contents and the like for such alloys are shown in TABLE 1.

As seen from TABLE 1, the alloys obtained by the apparatus in accordance with the present invention exhibits generally uniform Cr contents and complies with the desired specification. On the other hand, Cr contents of the alloys obtained by the conventional batch process vary widely, and besides there is an alloy which does not meet the specification.

TABLE 1

| | Cr—Cu alloys obtained by the apparatus of the invention | Cr—Cu alloys obtained by the conventional apparatus |
|---|---|---|
| Sampling number | 8 | 9 |
| Average Cr content (wt %) | 0.345 | 0.324 |
| Maximum Cr content (wt %) | 0.390 | 0.490 |
| Minimum Cr content (wt %) | 0.320 | 0.260 |
| Range | 0.070 | 0.230 |
| Standard deviation | 0.029 | 0.070 |

EXAMPLE 2

Zr-Cu alloys of a desired Zr content ranging from 0.07 to 0.13% by weight were manufactured by using the apparatus of FIGS. 1 and 2, and by the conventional batch process for comparison purposes. The data on Zr contents and the like for such alloys are shown in TABLE 2.

As seen from TABLE 2, the alloys obtained by the apparatus in accordance with the present invention exhibits a generally uniform Zr content and complies with the desired specification. On the other hand, Zr contents of the alloys obtained by the conventional batch process vary widely, and besides there is an alloy which does not meet requirements. Further, although Zr is reactive and is liable to oxidation, Zr contents of the alloys obtained by the apparatus of the invention are relatively higher as compared with the alloys obtained by the conventional process.

TABLE 2

| | Zr—Cu alloys obtained by the apparatus of the invention | Zr—Cu alloys obtained by the conventional apparatus |
|---|---|---|
| Sampling number | 8 | 8 |
| Average Zr content (wt %) | 0.098 | 0.058 |
| Maximum Zr content (wt %) | 0.107 | 0.105 |
| Minimum Zr content (wt %) | 0.095 | 0.018 |
| Range | 0.012 | 0.087 |
| Standard deviation | 0.005 | 0.034 |

EXAMPLE 3

Mg-Cu alloys of a desired Mg content ranging from 0.02 to 0.08% by weight were manufactured by using the apparatus of FIGS. 1 and 2, and by the conventional batch process for comparison purposes. The data on Mg contents and the like for such alloys are shown in TABLE 3.

As seen from TABLE 3, the alloys obtained by the apparatus in accordance with the present invention exhibits a generally uniform Mg content and complies with the desired specification. On the other hand, Mg contents of the alloys obtained by the conventional batch process vary widely, and besides there is an alloy which does not meet requirements. Further, as is the case with EXAMPLE 2, although Mg is reactive and is liable to oxidation, Mg contents of the alloys obtained by the apparatus of the invention are relatively higher as compared with the alloys obtained by the conventional process.

TABLE 3

| | Mg—Cu alloys obtained by the apparatus of the invention | Mg—Cu alloys obtained by the conventional apparatus |
|---|---|---|
| Sampling number | 8 | 8 |
| Average Mg content (wt %) | 0.055 | 0.030 |
| Maximum Mg content (wt %) | 0.058 | 0.050 |
| Minimum Mg content (wt %) | 0.052 | 0.008 |
| Range | 0.006 | 0.042 |
| Standard deviation | 0.002 | 0.019 |

EXAMPLE 4

Cr-Cu alloys of a desired Cr content ranging from 0.75 to 0.90% by weight were manufactured using the apparatus of FIG. 3 which includes the heating furnace 32. For comparison purposes, Cr-Cu alloys of the same desired Cr content were produced by the conventional batch process. The data on Cr contents and the like for such alloys are shown in TABLE 4.

As seen from TABLE 4, the alloys produced by the apparatus in accordance with the present invention exhibits a generally uniform Cr content and complies with the desired specification. On the other hand, Cr contents of the alloys obtained by the conventional batch process vary widely, and besides there are alloys which do not meet requirements.

TABLE 4

| | Cr—Cu alloys obtained by the apparatus of the invention | Cr—Cu alloys obtained by the conventional apparatus |
|---|---|---|
| Sampling number | 7 | 7 |
| Average Cr content (wt %) | 0.831 | 0.781 |
| Maximum Cr content (wt %) | 0.857 | 0.920 |
| Minimum Cr content (wt %) | 0.817 | 0.615 |
| Range | 0.040 | 0.305 |
| Standard deviation | 0.019 | 0.084 |

EXAMPLE 5

Granules of a pure Cr metal, each of which had a high melting point and had a purity of not less than 99.7% by weight and a granular size of 0.1 mm to 1.5 mm, were alloyed with copper using the apparatus of FIGS. 1 and 2, and a copper alloy which had a uniform chemical composition containing a Cr content of 1.1% by weight was successfully obtained. Similarly, smashed pieces of Ti each having a purity of not less than 99.6% by weight and a size of 3.0 mm to 5.0 mm, pieces of Zr each having a purity of not less than 98.0% by weight and a size of 1.0 mm×5.0 mm×10.0 mm, smashed pieces of Si each having a purity of not less than 99.9% by weight and a size of 3.0 mm×5.0 mm, spherical pieces of Ni each having a purity of not less than 99.8% by weight and a size of 8 mm, and pieces of Fe each having a purity of not less than 99.9% by weight and a size of 1 mm×2 mm to 5 mm were alloyed with copper, respectively, and copper alloys which contain Ti content of 2.5% by weight, Zr content of 0.2% by weight, Si content of 1.7% by weight, Ni content of 2.5% by weight, and Fe content of 2.3% by weight, respectively, were obtained.

EXAMPLE 6

A Cu-Cr-Ti-Si-Ni-Sn alloy was produced by the apparatus of FIGS. 1 and 2. In this case, by adding the alloying elements in the order of Cu-Cr-Ti-Si-Ni-Sn, an alloy having Cr content of 0.3% was obtained.

What is claimed is:

1. An apparatus for manufacturing a copper-base alloy, comprising:

an alloying spout inclined downwardly from one end toward the other end for flowing a molten copper therethrough, said alloying spout including an inlet at said one end and an outlet at said other end and having an elongated passageway through which said inlet communicates with said outlet, whereby the molten copper introduced from said inlet can flow downwardly through said passageway to said outlet;

a plurality of feeders for introducing solid solute constituents directly into said passageway of said alloying spout to thereby uniformly mix said solute constituents with said molten copper to produce a molten copper-base alloy, said feeders being connected to said alloying spout so as to be spaced longitudinally of said spout;

a tundish disposed at said other end of said alloying spout for receiving said molten copper-base alloy tapped from said alloying spout; and a heating furnace interposed between said alloying spout and said tundish for heating the molten copper-base alloy tapped from said alloying spout.

2. An apparatus according to claim 1, in which said heating furnace is an induction furnace.

3. An apparatus according to claim 1, in which said alloying spout and said tundish are respectively comprised of hermetically sealable casings.

4. An apparatus according to claim 1, in which said plurality of feeders comprises a first feeder for directly introducing a first solute constituent having a higher melting point than copper, and a second feeder for directly introducing a second solute constituent having a lower melting point than copper, said first feeder being connected to an upstream portion of said alloying spout adjacent to said one end while said second feeder is connected to a portion of said alloying spout spaced from said upstream portion towards said other end.

5. An apparatus for manufacturing a copper-base alloy comprising:

an alloying spout inclined downwardly from one end toward the other end for flowing a molten copper therethrough, said alloying spout including an inlet at said one end and an outlet at said other end and having an elongated passageway through which said inlet communicates with said outlet, whereby the molten copper introduced from said inlet can flow downwardly through said passageway to said outlet;

a plurality of feeders for introducing solid solute constituents directly into said passageway of said alloying spout to thereby uniformly mix said solute constituents with said molten copper to produce a molten copper-base alloy, said feeders being connected to said alloying spout so as to be spaced longitudinally of said spout;

a tundish disposed at said other end of said alloying spout for receiving said molten copper-base alloy tapped from said alloying spout; and a melting furnace for melting solid copper to produce said molten copper, a pouring spout for causing the molten copper produced in said melting furnace to flow therethrough, a holding furnace interposed between said pouring spout and said alloying spout for receiving said molten copper therein and keeping a temperature of the molten copper at a prescribed level, and a mold disposed adjacent to said tundish for casting said molten copper-base alloy to produce a cast product of the copper-base alloy.

6. An apparatus according to claim 1, in which said alloying spout includes heating means attached thereto for heating the molten copper passing through said passageway.

* * * * *

UNITED STATES PATENT AND TRADEMARK OFFICE

CERTIFICATE OF CORRECTION

PATENT NO. : 5,062,614

DATED : November 5, 1991

INVENTOR(S) : Izumi Sukekawa, et al.

It is certified that error appears in the above-identified patent and that said Letters Patent is hereby corrected as shown below:

Column 5, line 15, table 1: "9" should read as --8--

Signed and Sealed this

Twenty-eighth Day of September, 1993

*Attest:*

*Attesting Officer*

Bruce Lehman

BRUCE LEHMAN

*Commissioner of Patents and Trademarks*